US008655236B2

(12) United States Patent
Ushikubo

(10) Patent No.: US 8,655,236 B2
(45) Date of Patent: Feb. 18, 2014

(54) DEVELOPER STORAGE BODY, IMAGE FORMING UNIT AND IMAGE FORMING APPARATUS

(75) Inventor: Junichi Ushikubo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 181 days.

(21) Appl. No.: 13/283,643

(22) Filed: Oct. 28, 2011

(65) Prior Publication Data

US 2012/0114392 A1 May 10, 2012

(30) Foreign Application Priority Data

Nov. 9, 2010 (JP) ..... 2010-250931

(51) Int. Cl.
*G03G 15/08* (2006.01)

(52) U.S. Cl.
USPC ..... 399/262; 399/120; 399/258

(58) Field of Classification Search
USPC ..... 399/262, 120, 258
See application file for complete search history.

(56) References Cited

U.S. PATENT DOCUMENTS 5,576,803 A * 11/1996 Williams et al. ..... 399/116
7,840,167 B2 * 11/2010 Taguchi et al.

FOREIGN PATENT DOCUMENTS

| | | | |
|---|---|---|---|
| EP | 0 701 181 | A2 | 3/1996 |
| EP | 0 708 384 | A2 | 4/1996 |
| EP | 2 110 714 | A2 | 10/2009 |
| JP | 2006-154191 | | 6/2006 |
| JP | 2006-243446 | A | 9/2006 |
| JP | 2006-343560 | A | 12/2006 |
| JP | 2007-058250 | A | 3/2007 |

OTHER PUBLICATIONS

Machine translation of JP 2006-154191 (Saiki et al., published on Jun. 15, 2006) dated Jun. 24, 2013.*
Machine translation of JP 2007-058250 (Yabuki et al., published on Mar. 8, 2007) dated Jun. 24, 2013.*

* cited by examiner

*Primary Examiner* — Sophia S Chen
(74) *Attorney, Agent, or Firm* — Rabin & Berdo, P.C.

(57) ABSTRACT

A developer storage body includes a housing in which a developer is stored, a shutter portion mounted to the housing and having a hole portion through which the developer is replenished into the housing, and a cap portion covering the hole portion. The cap portion includes a structural portion that constitutes an enclosure body enclosing a hollow portion. The structural portion is formed of a first material. The cap portion further includes a seal portion that covers the structural portion to seal the hollow portion. The seal portion is formed of a second material having a lower flexural modulus than the first material.

24 Claims, 14 Drawing Sheets

DEVELOPER STORAGE BODY, IMAGE FORMING UNIT AND IMAGE FORMING APPARATUS

BACKGROUND OF THE INVENTION

The present invention relates to a developer storage body, an image forming unit and an image forming apparatus. The present invention particularly relates to a cap mounted to a replenishing opening for replenishing a developer into the developer storage body.

A developer storage body of a general image forming apparatus has a replenishing opening for replenishing a toner (i.e., developer) into the developer storage body. In order to close the replenishing opening, a cap is mounted to the opening. Such a cap is disclosed in, for example, Japanese Laid-open Patent Publication No. 2006-243446 (see, paragraph 0031 and FIG. 4).

Recently, there is a demand for ensuring prevention of a leakage of the developer form the developer storage body.

SUMMARY OF THE INVENTION

In an aspect of the present invention, it is intended to effectively prevent a leakage of a developer from a developer storage body.

According to an aspect of the present invention, there is provided a developer storage body including a housing in which a developer is stored, a shutter portion mounted to the housing and having a hole portion through which the developer is replenished into the housing, and a cap portion covering the hole portion. The cap portion includes a structural portion that constitutes an enclosure body enclosing a hollow portion, the structural portion being formed of a first material, and a seal portion that covers the structural portion to seal the hollow portion. The seal portion is formed of a second material having a lower flexural modulus than the first material.

With such a configuration, it becomes possible to suppress the leakage of the developer.

According to another aspect of the present invention, there is provided an image forming unit including the above described developer storage body.

According to still another aspect of the present invention, there is provided an image forming apparatus including the above described image forming unit.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings.

First Embodiment

<Configuration>

Figure 1:
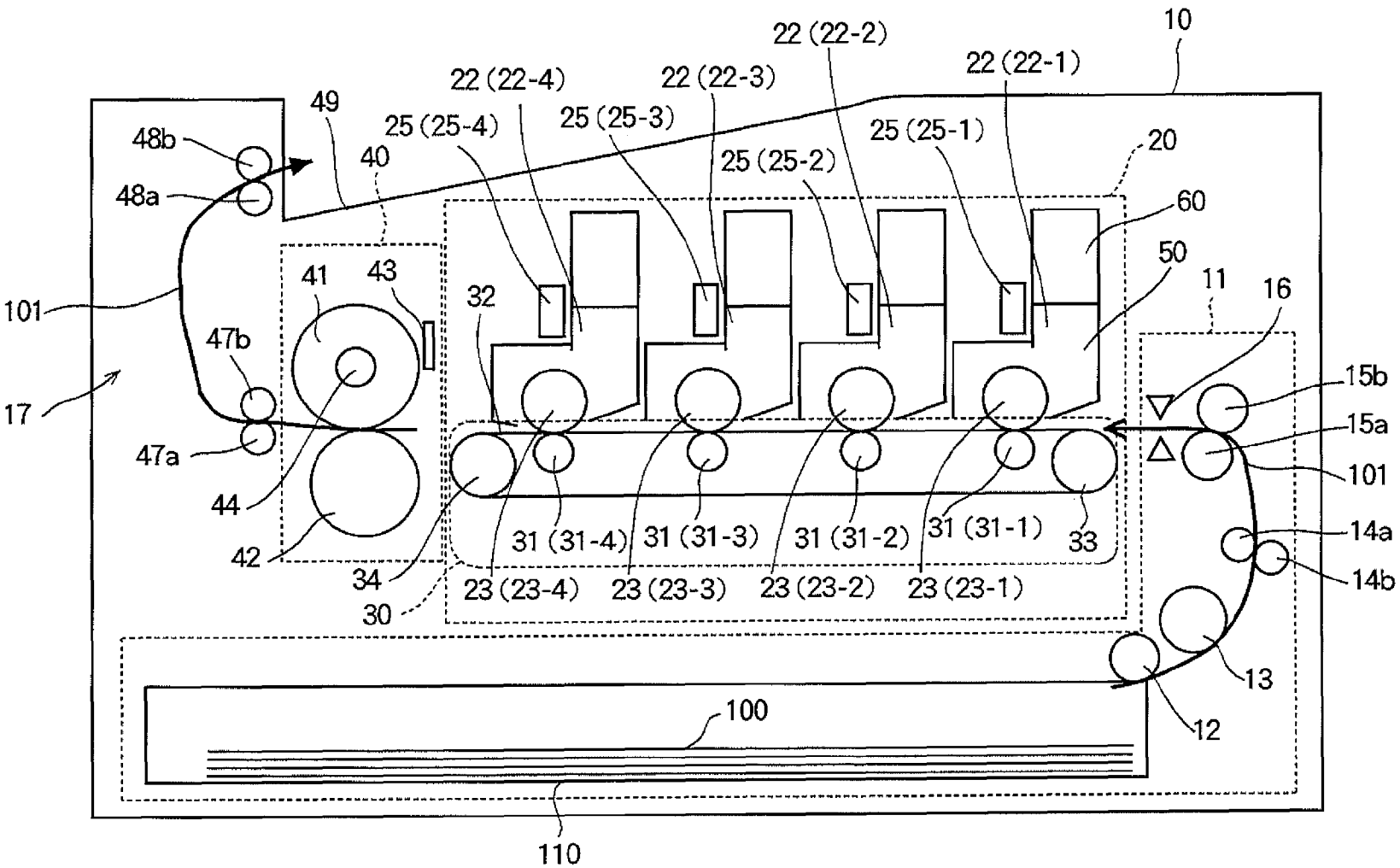
FIG. 1 is a schematic side view showing an image forming apparatus according to the first embodiment of the present invention.

FIG. 1 is a schematic sectional side showing an image forming apparatus 10 according to the first embodiment of the present invention. The image forming apparatus 10 is configured as a tandem-type printer, and includes a feeding mechanism 11 that conveys a recording medium 100 (for example, a sheet) along a conveying path 101, an image forming portion 20 that forms a toner image (a developer image) on the recording medium 100, a fixing portion 40 that fixes the toner image to the recording medium 100, a medium ejection portion 17 that ejects the recording medium 100 to which the toner image is fixed, and a stacker portion 49 on which the ejected printing medium 100 is placed. Further, the image forming apparatus 10 includes not shown motors for rotating the respective rollers, clutches for connecting or disconnecting a transmission of power to the respective rollers disposed along the conveying path 101, high voltage power sources for applying high voltages of 200-5000V to respective parts of the image forming portion 20, and low voltage power sources for applying low direct voltages of 5V and 24V to circuits or the motors.

The feeding mechanism 11 includes a feeding cassette 110 (as a medium storage portion) storing the recording media 100 and mounted to a lower part of the image forming apparatus 10. The feeding mechanism 11 further includes a pickup roller 12 that feeds the recording medium 100 one by one from the feeding cassette 110. The feeding mechanism 11 further includes a feeding roller (a separation roller) 13, a pair of conveying rollers 14*a* and 14*b*, another pair of conveying rollers 15*a* and 15*b*, and a writing position sensor 16.

The feeding cassette 110 is configured to store a plurality of recording media 100, and is detachably mounted to the lower part of the image forming apparatus 10. The recording medium 100 is, for example, a high-quality paper, a recycled paper, a gross paper, a Mat paper, an OHP (Overhead Projector) film or the like having a predetermined size used for printing a monochrome or color image thereon.

The pickup roller 12 is pressed against the recording medium 100, and rotates to feed the recording medium 100 out of the feeding cassette 110. The feeding roller 13 is provided on a downstream side of the pickup roller 12 along the conveying path 101. The conveying rollers 14*a* and 14*b* are provided on the downstream side of the feeding roller 13 along the conveying path 101 so as to face each other via the recording medium 100. The conveying rollers 15*a* and 15*b* are provided on the downstream side of the conveying rollers 14*a* and 14*b* along the conveying path 101 so as to face each other via the recording medium 100. The writing position sensor 16 is provided on the downstream side of the conveying rollers 15*a* and 15*b* along the conveying path 101. The conveying rollers 14*a* and 15*a* are driven by a not shown conveyance motor.

The image forming portion 20 includes four image forming units 22 (i.e., 22-1, 22-2, 22-3 and 22-4) of black, yellow, magenta and cyan arranged in this order along the conveying path 101. The image forming portion further includes LED (Light Emitting Diode) heads 25 (25-1, 25-2, 25-3 and 25-4) provided above the image forming units 22, and a transfer unit 30 provided below the image forming units 22.

Figure 3:
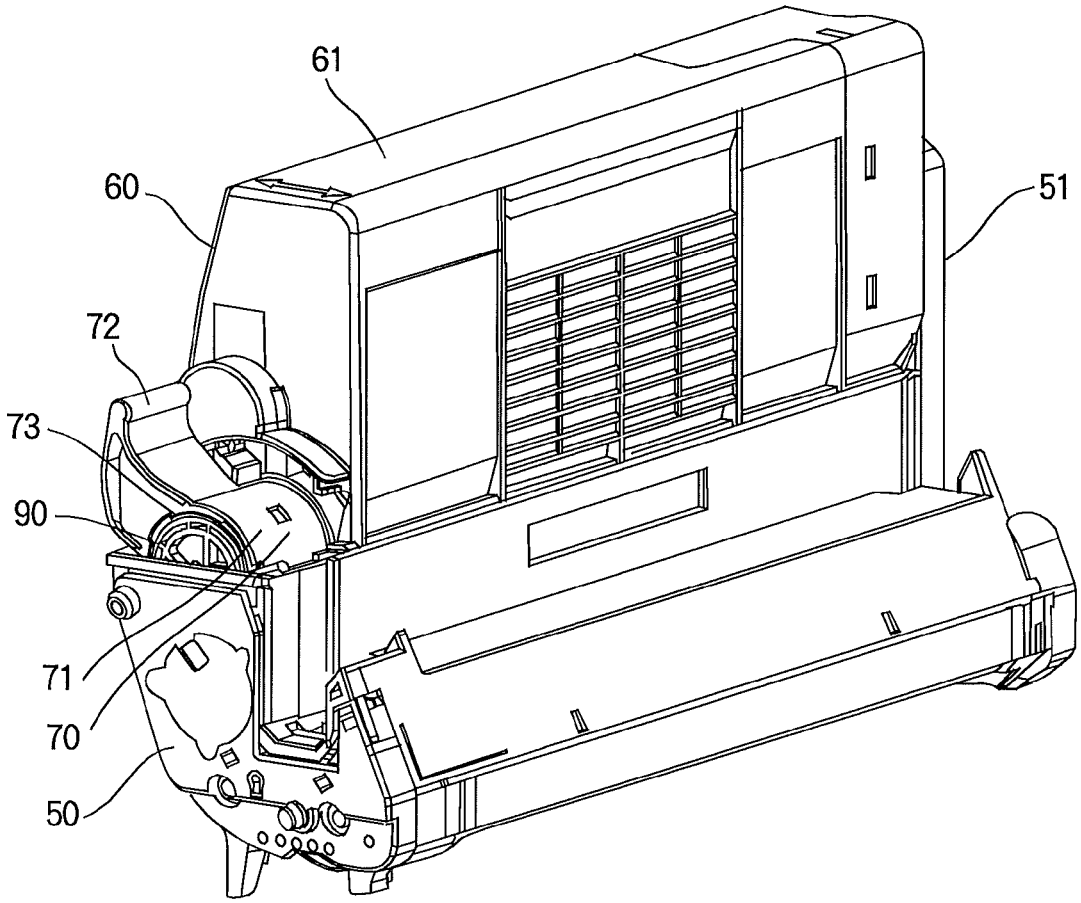
FIG. 3 is a perspective view showing the image forming unit according to the first embodiment of the present invention.

Each of the image forming units 22 (22-1, 22-2, 22-3 and 22-4) includes an image forming unit main body 50 and a toner cartridge 60 as a developer storage body detachably mounted to an upper side of the image forming unit main body 50. The image forming unit main bodies 50 include photosensitive drums 23 (23-1, 23-2, 23-3 and 23-4) as latent image bearing bodies, and further include charging rollers 24, developing rollers 26, toner supplying rollers 27, developing blades 28 and cleaning blades 29 (FIG. 3).

The transfer unit 30 includes transfer rollers 31 (31-1, 31-2, 31-3 and 31-4) provided below the image forming units 22 (22-1, 22-2, 22-3 and 22-4), and further includes a driving roller 33, a driven roller 34, and a conveying belt 32 stretched around the driving roller 33 and the driven roller 34. The conveying belt 32 has a function to convey the recording medium 100 and to transfer the toner image from the photosensitive drums 23 to the recording medium 100. The transfer rollers 31 contact the photosensitive drums 23 via the conveying belt 32. The transfer unit 30 and the feeding mechanism 11 constitute a medium conveying portion.

The fixing portion 40 as the fixing unit includes a fixing roller 41, a pressure roller 42, a temperature detecting sensor 43, and a halogen heater 44 such as a halogen lamp provided in the fixing roller 41. The temperature detecting sensor 43 such as a thermistor is provided on an upstream side of the fixing roller 41 in a conveying direction of the recording medium 100. The temperature detecting sensor 43 detects the temperature of the fixing roller 41.

The medium ejection portion 17 includes a pair of conveying rollers 47*a* and 47*b* and a pair of ejection rollers 48*a* and 48*b*. The conveying rollers 47*a* and 47*b* are provided so as to face each other via the conveying path 101. The ejection rollers 48*a* and 48*b* are provided so as to face each other via the conveying path 101. The conveying rollers 47*a* and 47*b* and the ejection rollers 48*a* and 48*b* are driven by a not shown motor.

Figure 2:
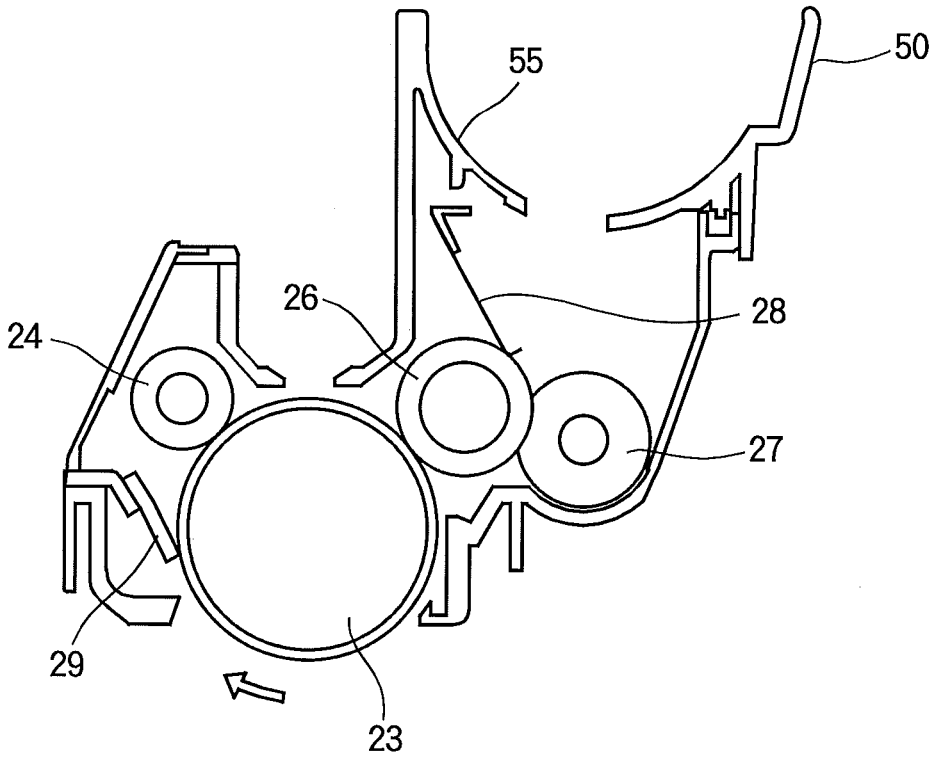
FIG. 2 is a sectional view of showing an image forming unit main body according to the first embodiment of the present invention.

FIG. 2 is a schematic view showing the image forming unit main body 50 according to the first embodiment.

The image forming unit main body 50 includes the photosensitive drum 23 that bears a latent image, the charging roller 24 as a charging member that uniformly charges the surface of the photosensitive drum 23, the developing roller 26 as a developer bearing body that develops the latent image on the surface of the photosensitive drum 23 using a toner as a developer, and the toner supply roller 27 as a developer supply member that supplies the toner to the developing roller 26. The image forming unit main body 50 further includes the developing blade 28 as a developer regulating member that regulates a thickness of the toner layer on the surface of the developing roller 26, and the cleaning blade 29 as a cleaning member that removes the residual toner from the photosensitive drum 23. A cartridge mounting portion 55 (i.e., a recess portion) in the form of a recess is formed on the upper part of the image forming unit main body 50. In the image forming unit main body 50, a gap is formed on the upper side of the photosensitive drum 23. The LED head 25 shown in FIG. 1 emits light to expose the surface of the photosensitive drum 23.

The photosensitive drum 23 includes a conductive base layer made of aluminum or the like and a photoconductive layer formed on the conductive base layer. The photoconductive layer includes a charge generation layer and a charge transport layer. The photosensitive drum 23 has a cylindrical shape, and is rotatably supported. The photosensitive drum 23 contacts the charging roller 24, the developing roller 26, the transfer roller 31, and an end portion of the cleaning blade 29. The photosensitive drum 23 is capable of holding electric charge at a surface thereof, and functions as an image bearing body that bears a toner image. The photosensitive drum 23 rotates in a direction shown by an arrow in FIG. 2. Hereinafter, components provided around the photosensitive drum 23 will be described along the rotational direction of the photosensitive drum 23.

The charging roller 24 is formed of a metal shaft having electrical conductivity covered with a semiconductive rubber such as a silicone rubber, and has a cylindrical shape. The charging roller 24 is rotatably supported, and is pressed against the photosensitive drum 23. The charging roller 24 is applied with a voltage by a charging power source (not shown). As the charging roller 24 rotates while being pressed against the photosensitive drum 23, the charging roller 24 applies a predetermined voltage to the photosensitive drum 23, so as to uniformly charge the surface of the photosensitive drum 23.

The LED head 25 (FIG. 1) includes a plurality of LEDs, a rod lens array and LED driving elements, and is provided above the photosensitive drum 23. The LED head 25 is configured to emit light so as to expose the surface of the photosensitive drum 23 based on image data to thereby form a latent image on the surface of the photosensitive drum 23.

The toner supply roller 27 is formed of a metal shaft having electrical conductivity covered with a rubber, and has a cylindrical shape. The toner supply roller 27 is provided contacting the surface of the developing roller 26. The toner supply roller 27 is applied with a voltage by a supply power source (not shown), and contacts the developing roller 26 so as to supply the toner to the developing roller 26.

The developing roller 26 is formed of a metal shaft having electrical conductivity covered with a semiconductive urethane rubber or the like, and has a cylindrical shape. The developing roller 26 contacts the toner supply roller 27, the photosensitive drum 23 and an end portion the developing blade 28. The developing roller 26 is applied with a voltage by a developing power source (not shown), and contacts the toner supply roller 27 so that the toner is supplied to the developing roller 26 from the toner supply roller 27.

The developing blade 28 is formed of stainless or the like, and has a plate shape. The developing blade 28 is provided so that the end portion of the developing blade 28 contacts the surface of the developing roller 26. The developing blade 28 regulates a thickness of the toner layer on the surface of the developing roller 26 to a constant thickness by scraping off excessive amount of the toner on the developing roller 26.

The cleaning blade 29 is made of rubber or the like, and has a plate shape. The cleaning blade 29 is provided so that the end portion of the cleaning blade 29 contacts the surface of the photosensitive drum 23. The cleaning blade 29 cleans the surface of the photosensitive drum 23 by scraping off the residual toner that remains on the photosensitive drum 23 after the toner image is transferred to the recording medium 100. The scraped-off toner is ejected by means of a waste toner ejection portion 53 (FIG. 4A) described later.

The toner cartridge mounting portion 55 (in the form of a recess) is formed on the image forming unit main body 50. A space is provided below the recess, and the toner is supplied to the toner supply roller 27 via the space.

FIG. 3 is a perspective view showing the image forming unit 22 (i.e., the main body 50 and the toner cartridge 60) according to the first embodiment of the present invention. As shown in FIG. 3, the image forming unit main body 50 includes a side plate 51. The toner cartridge 60 is mounted to the upper part of the image forming unit main body 50. The toner cartridge 60 includes an outer cartridge 61 as a housing that stores the toner therein, and a shutter portion 70 provided in the outer cartridge 61. The toner cartridge 60 has an elongated shape. The shutter portion 70 protrudes from a side wall (i.e., a longitudinal end) of the outer cartridge 61. The shutter portion 70 has a hole portion 73.

The shutter portion 70 includes an enclosure portion 71 having a substantially cylindrical shape, an operation lever 72 (i.e., an operating portion) protruding upward from the enclosure portion 71, and the hole portion 73 formed on the enclosure portion 71.

The hole portion 73 is provided for replenishing the toner into an inner space of the outer cartridge 61, and is connected to the inner space of the outer cartridge 61. The toner can be replenished into the toner cartridge 60 through the hole portion 73. A toner cap 90 as a cap portion is press-fitted into the hole portion 73. The toner cap 90 seals the hole portion 73 so as to prevent the leakage of the toner (replenished into the outer cartridge 61 via the hole portion 73) through the hole portion 73. That is, the toner cap 90 functions as a cap portion covering the hole portion 73 of the shutter portion 70.

In this regard, if the toner cap 90 is entirely formed of a soft flexible member, the toner cap 90 is likely to deform when applied with a force. Such a deformation of the toner cap 90 may cause the leakage of the toner. Further, if the toner cap 90 is entirely formed of a hard material, a gap may be formed between the hole portion 73 and the toner cap 90, which may allow the leakage of the toner, and a detachment of the toner cap 90 may become difficult. In this embodiment, the leakage of the toner is prevented by having a configuration described later.

Figure 4A:
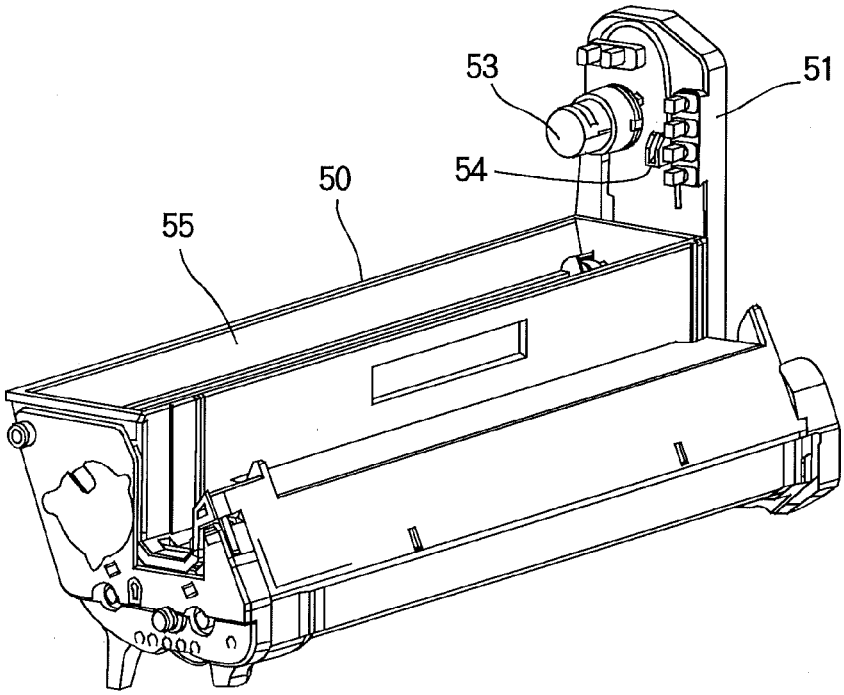
FIGS. 4A and 4B are perspective views showing the image forming unit main body according to the first embodiment of the present invention.
Figure 4B:
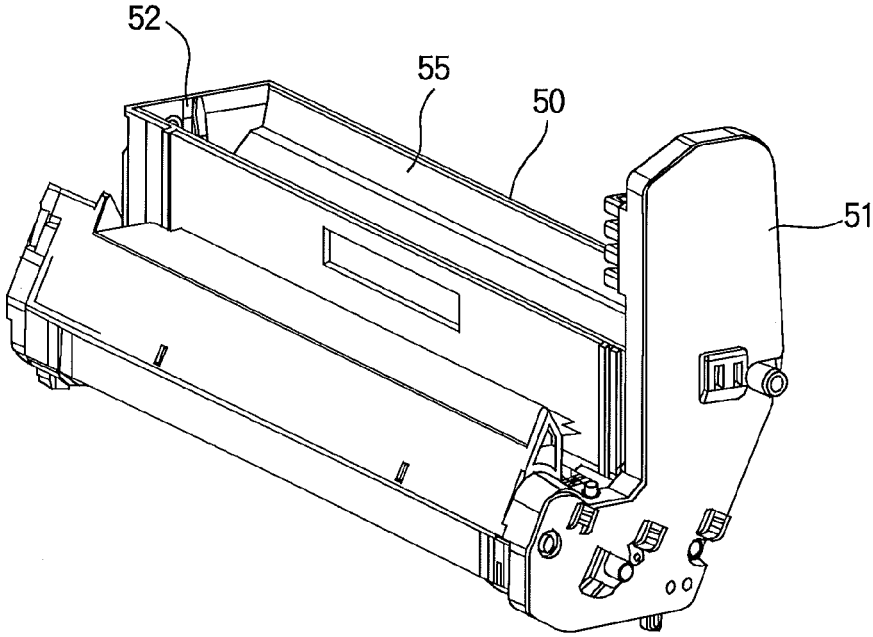

FIGS. 4A and 4B are perspective views showing the image forming unit main body 50 according to the first embodiment.

The image forming unit main body 50 includes the side plate 51 that supports the toner cartridge 60, a protrusion 52 that engages a hollow portion 93 of the toner cap 90, a waste toner ejection portion 53 that ejects the toner scraped off from the photosensitive drum 23 by the cleaning blade 29 (FIG. 2), a convex portion 54 that engages the toner cartridge 60 (to fix the toner cartridge 60), and the toner cartridge mounting portion 55 to which the toner cartridge 60 is mounted.

Figure 5A:
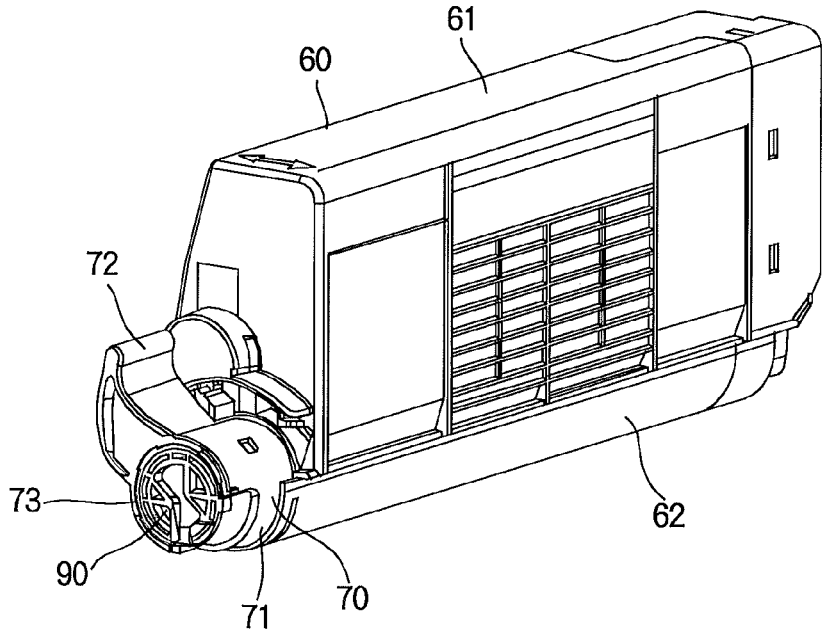
FIGS. 5A and 5B are perspective views showing toner cartridges according to the first embodiment of the present invention.
Figure 5B:
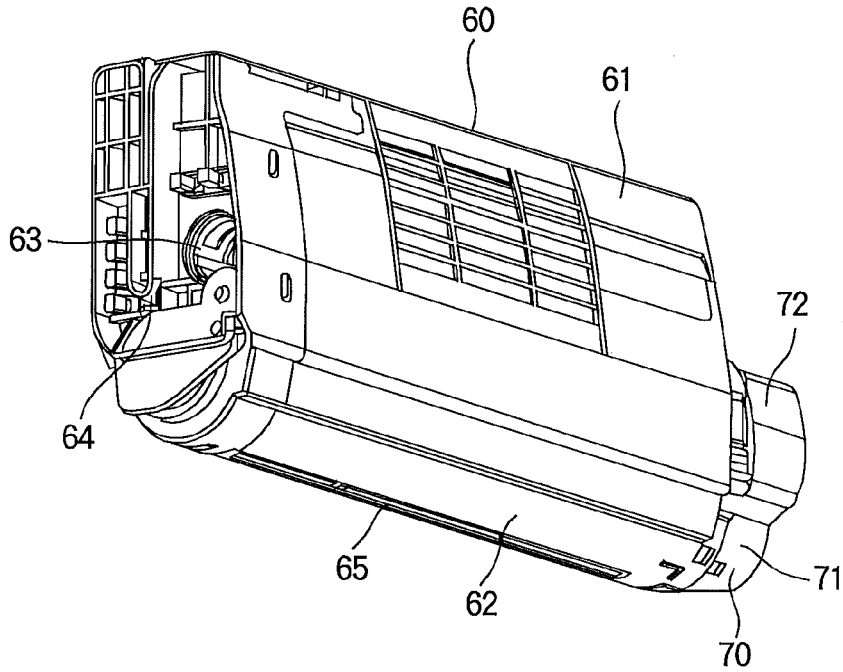

FIGS. 5A and 5B are perspective views showing the toner cartridge 60 according to the first embodiment.

The toner cartridge 60 is mounted to the upper part of the image forming unit main body 50, and has a function to supply a fresh toner to the image forming unit main body 50. The toner cartridge 60 also has a function to store the waste toner collected by the image forming unit main body 50.

As shown in FIG. 5A, the toner cartridge 60 includes the outer cartridge 61 that constitutes the housing of the toner cartridge 60 as described above. The shutter portion 70 is provided in the outer cartridge 61, and an end of the shutter portion 70 protrudes from the side wall of the outer cartridge 61.

As shown in FIG. 5B, the outer cartridge 61 has a bottom wall 62 having an arcuate cross section. Further, a waste toner receiving opening 63 and a rib portion 64 are provided on a side wall of the outer cartridge 61 opposite to the side wall on which the operation lever 72 is provided. The waste toner receiving opening 63 is in the form of a cylindrical hole. The rib portion 64 is in the form of a plate which is perpendicular to the side wall of the outer cartridge 61. A toner supply opening 65 is formed on the bottom wall 62. The toner supply opening 65 is in the form of an elongated rectangular hole extending in the longitudinal direction of the outer cartridge 61. The toner supply opening 65 is formed on the outer cartridge 61 so as to face the shutter portion 70.

The toner cartridge 60 supplies the toner (i.e., a fresh toner) to the image forming unit main body 50 via the toner supply opening 65. When the toner cartridge 60 is mounted to the image forming unit main body 50, the convex portion 54 (FIG. 4A) of the image forming unit main body 50 engages the rib portion 64 of the toner cartridge 60. The waste toner receiving opening 63 of the toner cartridge 60 engages the waste toner ejection portion 53 of the image forming unit main body 50 (FIG. 4A). The toner is supplied from the waste toner ejection portion 53 into the toner cartridge 60 via the waste toner ejection portion 53.

Figure 6:
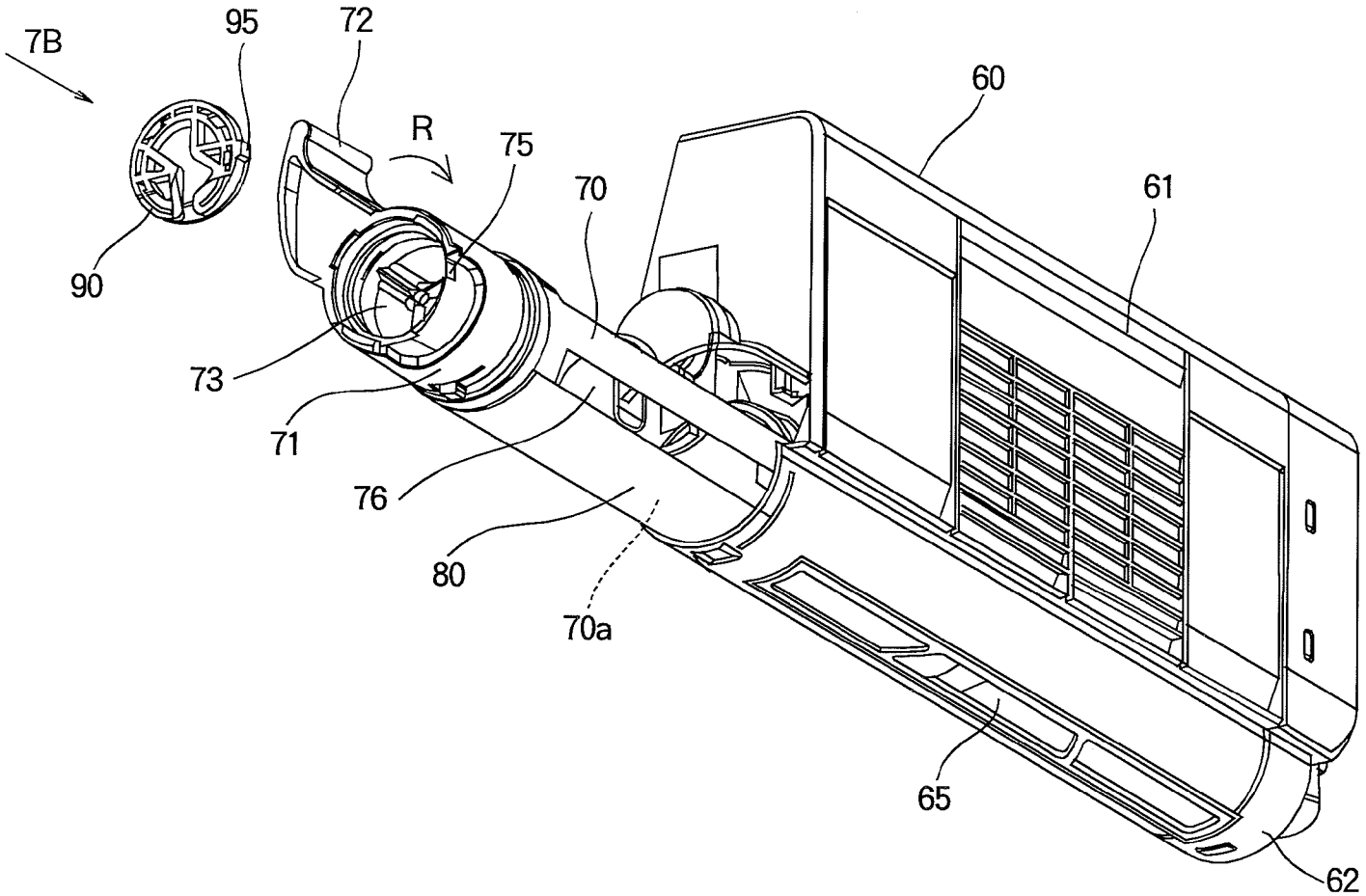
FIG. 6 is an exploded perspective view showing the toner cartridge according to the first embodiment of the present invention.

FIG. 6 is a perspective view showing the toner cartridge 60 of the first embodiment.

The toner cartridge 60 includes the outer cartridge 61 with the bottom wall 62 having the arcuate cross section, and the shutter portion 70 detachably mounted to the outer cartridge 61. The toner supply opening 65 is formed on the bottom wall 62 of the outer cartridge 61. The cylindrical shutter portion 70 has a shutter 80 at a lower portion thereof. The shutter portion 70 has a wall portion 70*a* located inside the outer cartridge 61. An upper part of the wall portion 70*a* is opened. A predetermined region of a lower part of the portion 70*a* is covered with the shutter 80. An opening 76 is formed at a region on the wall portion 70*a* adjacent to the shutter 80. A seal member such as a sponge is bonded to a periphery of the shutter 80. In a state where the shutter 80 closes the toner supply opening 65, the seal member prevents the leakage of the toner through the toner supply opening 65.

A part of the shutter portion 70 located outside the outer cartridge 61 includes the above described enclosure portion 71 having a substantially cylindrical shape, the operation lever 72 protruding upward from the enclosure portion 71, and the hole portion 73 formed on the enclosure portion 71. The hole portion 73 is connected to the inner space of the outer cartridge 61, and is used to supply the toner into the inner space of the outer cartridge 61. The hole portion 73 is closed by the toner cap 90 press-fitted into the hole portion 73. The hole portion 73 has a guide groove 75 as a first direction-regulating portion. The toner cap 90 has a guide portion as a second direction-regulating portion. The guide portion 95 of the toner cap 90 engages the guide groove 75 of the hole portion 73. The guide portion 95 guides the toner cap 90 so that the toner cap 90 is press-fitted into the hole portion 73 in a predetermined direction.

The shutter 80 (FIG. 6) is provided on the lower part of the shutter portion 70, and is located at a position so that the shutter 80 closes the toner supply opening 65. When the enclosure portion 71 is rotated clockwise (as shown by an arrow R in FIG. 6) by the operation lever 72, the shutter 80 also rotates clockwise, and the opening 76 is aligned with the toner supply opening 65 to thereby open the toner supply opening 65. In this state, the toner stored in the toner cartridge 60 is supplied to the image forming unit main body 50. That is, the shutter 80 functions as a shutter portion that opens the toner supply opening 65 in conjunction with the rotation of the shutter portion 70.

Figures 7A, 7B, 7C:
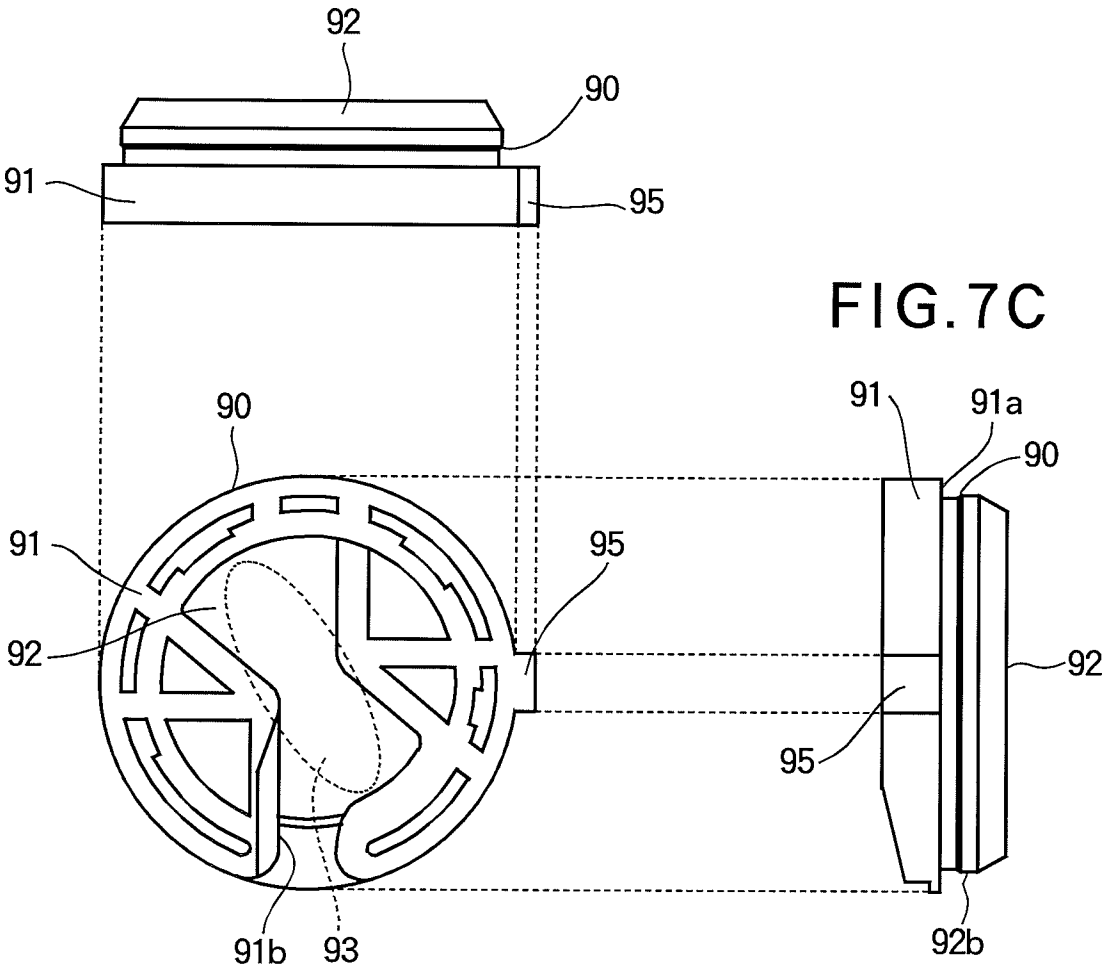
FIGS. 7A, 7B and 7C are front, bottom and side views showing a toner cap according to the first embodiment of the present invention.
Figure 8A:
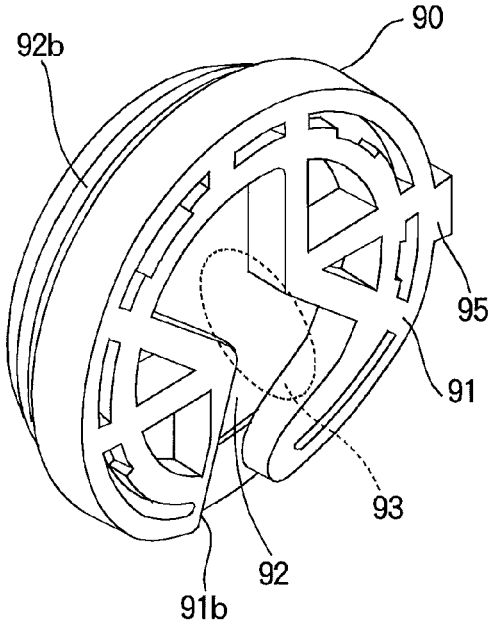
FIGS. 8A and 8B are perspective views showing the toner cap according to the first embodiment of the present invention.
Figure 8B:
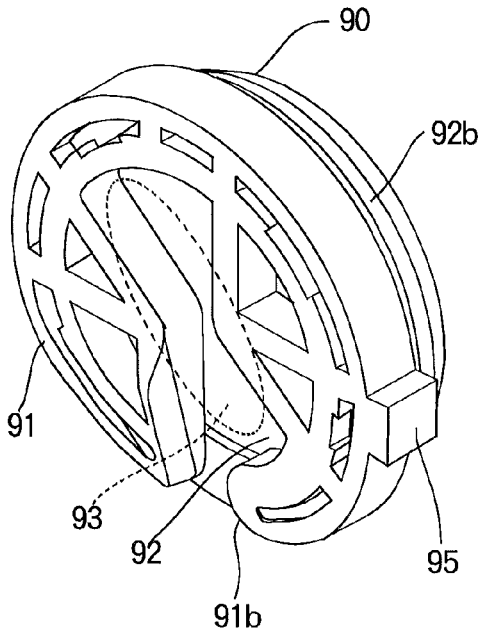

FIGS. 7A, 7B and 7C are front, bottom and side views of the toner cap 90 according to the first embodiment. In this regard, the bottom view (FIG. 7B) corresponds to a view as seen in a direction shown by an arrow 7B in FIG. 6. FIGS. 8A and 8B are perspective views of the toner cap 90 according to the first embodiment.

The toner cap 90 as a cap portion includes a rib portion 91 as a structural portion, and a seal portion 92. The rib portion 91 constitutes an enclosure body (having a circular shape) of the toner cap 90, and has a hollow portion 93 enclosed thereby. In particular, the hollow portion 93 is defined by a plurality of ribs of the rib portion 91. An opening 91*b* is formed at a lower end of the rib portion 91, and is connected to the hollow portion 93. The seal portion 92 covers the rib portion 91, and seals the hollow portion 93. In a state where the toner cap 90 is fitted into the hole portion 73 (as shown in FIG. 11B described later), the rib portion 91 is disposed outside the seal portion 92.

The rib portion 91 has a hole-sealing surface 91*a* (as a second surface) in the form of a ring. In a state where the toner cap 90 is fitted into the hole portion 73, the hole-sealing surface 91*a* contacts a ring-shaped end surface 73*a* (FIG. 11A) of the hole portion 73 so as to seal the hole portion 73.

The seal portion 92 has a cylindrical hole-sealing portion 92*b* which is perpendicular to the hole-sealing surface 91*a*. In a state where the toner cap 90 is fitted into the hole portion 73, the hole-sealing portion 92*b* contacts an inner wall 73*b* (FIG. 11B) of the hole portion 73 to prevent the leakage of the toner.

A part of the rib portion 91 protrudes outward in one direction to form the guide portion 95. As described above, the guide portion 95 has a function to guide the toner cap 90 so that the toner cap 90 is fitted into the hole portion 73 in the predetermined direction.

The rib portion 91 and the seal portion 92 are formed of mutually different materials having different hardness. The rib portion 91 is formed of a first material which is hard (i.e., high flexural modulus) and less likely to deform. For example, the rib portion 91 is formed of polycarbonate whose flexural modulus is 2200 MPa. The seal portion 92 is formed of a second material that is softer than the first material and that has lower flexural modulus than the first material. For example, the seal portion 92 is formed of ethylene-vinyl acetate whose flexural modulus is 100 MPa.

It is also possible that the flexural modulus of the first material is in a range approximately from 0.5 to 2.0 times the above described flexural modulus (2200 MPa). Similarly, it is also possible that the flexural modulus of the second material is in a range approximately from 0.5 to 2.0 times the above described flexural modulus (100 MPa). For example, the rib portion 91 can be formed of a first material whose flexural modulus is in a range from 1000 to 5000 MPa, and the seal portion 92 can be formed of a second material whose flexural modulus is in a range from 50 to 200 MPa.

If the flexural modulus of the rib portion 91 is lower than 1000 MPa, the rib portion 91 is likely to deform. In such a case, the rib portion 91 cannot effectively prevent deformation of the seal member 92, and may allow leakage of the toner. If the flexural modulus of the seal portion 92 is higher than 200 MPa, the hole-sealing portion 92*b* does not easily deform and cannot be press-fitted into the hole 73, so that the hole-sealing portion 92*b* cannot fulfill a sealing function. If the flexural modulus of the seal portion 92 is lower than 50 MPa, the hole-sealing portion 92*b* is likely to deform, and may allow the leakage of the toner.

In the toner cap 90 of the first embodiment, the rib portion 91 (i.e., a harder portion) is formed with a rib structure having the hollow portion 93, and does not cover an entire surface of the seal portion 92. The seal portion 92 (i.e., a softer portion having low flexural modulus) is exposed via the hollow portion 93 of the rib portion 91. Therefore, when replenishing the toner to the toner cartridge 60, the toner cap 90 can be easily detached from the hole portion 73 by breaking through the exposed part of the soft seal portion 92 using a bar, screwdriver or the like, and by forcing the toner cap 90 open using the bar or the like (penetrating the seal portion 92) according to the principle of leverage. It is unnecessary to use a special tool. In this regard, if the toner cap 90 is detached by breaking the seal portion 92 as described above, it is preferable to replace the toner cap 90 (having been detached) with a new toner cap 90.

In this regard, the flexural modulus "Eb" is calculated based on a load-deflection curve obtained by three-point bending test, and is determined using the following equation (1).

$$Eb(\text{MPa}) = \frac{L}{4Wh^3} \times \frac{F}{Y} \tag{1}$$

In the equation (1), "L" indicates a distance (mm) between fulcrums, "W" indicates a width (mm) of a test piece, "h" indicates a thickness (mm) of the test piece, "F" indicates a load arbitrarily selected from a straight part of the load-deflection curve, and "Y" indicates an amount of deflection (mm) of the test piece when a load F is applied to the test piece. The flexural modulus Eb is determined according to JIS K7203 (1982).

Figure 9:
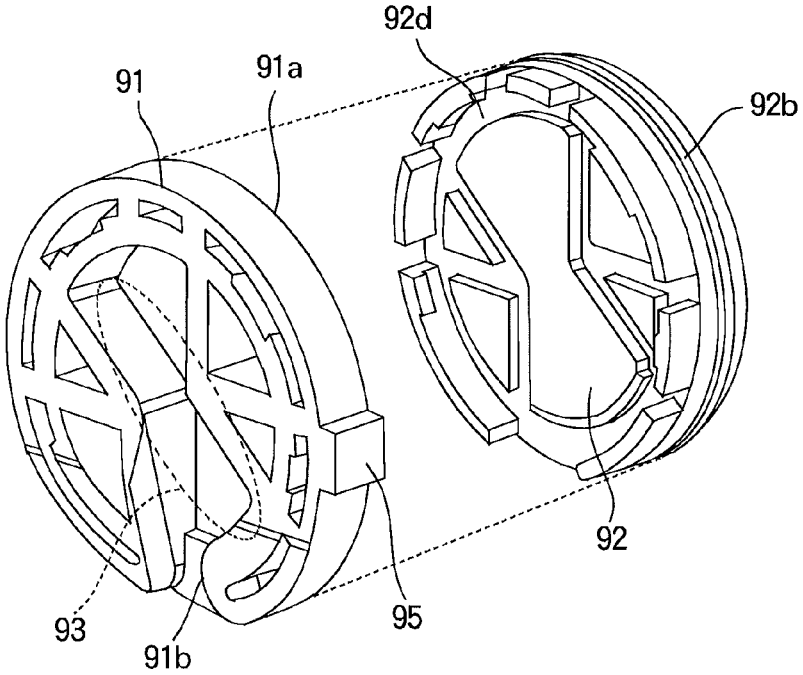
FIG. 9 is an exploded perspective view showing the toner cap according to the first embodiment of the present invention.

FIG. 9 is an exploded perspective view showing the toner cap 90 according to the first embodiment. The toner cap 90 includes the rib portion 91 and the seal portion 92 formed of mutually different materials as described above. The toner cap 90 is integrally formed at a single process using double molding technique. That is, the rib portion and the seal portion 92 are formed at the same time (i.e., formed by the same process). For example, the first material for the rib portion 91 is polycarbonate, and the second material for the seal portion 92 is ethylene-vinyl acetate. The seal portion 92 has the above described hole-sealing portion 92*b* (FIG. 7C), and also has a rib covering surface 92*d* as a first surface that mates with (and covers) the rib portion 91.

<Operation>

Next, an operation of the image forming apparatus 10 will be described with reference to FIGS. 1 and 2.

The recording medium 100 is conveyed from the upstream to the downstream along the conveying path 101. The feeding cassette 110 is disposed on the upstream end of the conveying path 101, and the stacker portion 49 is disposed on the downstream end of the conveying path 101.

The image forming apparatus 10 is connected to a host device using a wire or wirelessly. When the image forming apparatus 10 receives printing command and image data from the host device, the pickup roller 12 starts rotating by a pickup motor (not shown), to pickup and feed the recording medium 100 into the conveying path 101. The image forming units 22 (22-1, 22-2, 22-3 and 22-4) of black, yellow, magenta and cyan are arranged in this order from the right to the left in FIG. 1 as described above. In each of the image forming units 22 (22-1, 22-2, 22-3 and 22-4), respective rollers start rotating substantially at the same time as the start of the feeding of the recording medium 100. In this regard, the photosensitive roller 23 rotates at least one turn before the recording medium 100 reaches the photosensitive drum 23.

The feeding roller 13 is driven by a not shown motor and feeds the recording medium 100 (picked up by the pickup roller 12) along the conveying path 101. The recording medium 100 is further conveyed along the conveying path 101 by the conveying rollers 14*a* and 14*b* and the conveying rollers 15*a* and 15*b*, and causes the writing position sensor 16 to be turned on. The LED heads 25 start emitting light at predetermined timings after the writing position sensor 16 is turned on. The photosensitive drums 25 of the image forming units 22 (22-1, 22-2, 22-3 and 22-4) of black, yellow, magenta and cyan are exposed with light, and latent images are formed thereon corresponding to respective colors.

The recording medium 100 reaches the conveying belt 32 at the downstream side of the writing position sensor 16. When the driving roller 33 rotates, the conveying belt 32 stretched around the driving roller 33 and the driven roller 34 is driven to rotate. The recording medium 100 is conveyed by the conveying belt 32 to pass through the image forming units 22 (22-1, 22-2, 22-3 and 22-4) of black, yellow, magenta and cyan.

As shown in FIG. 2, in each of the image forming units 22 (22-1, 22-2, 22-3 and 22-4), the photosensitive drum 23 rotates clockwise in FIG. 1, and the charging roller 24 uniformly charges the surface of the photosensitive drum 23. The LED head 25 emits light to expose the uniformly charged surface of the photosensitive drum 23 based on image data (sent from the host device) to form a latent image. The developing roller 26 is supplied with the toner by the toner supply roller 27, and develops the latent image on the surface of the photosensitive drum 23 to form a toner image. The photosensitive drum 23 and the transfer roller 31 nip the recording medium 100 therebetween, and the transfer roller 31 is applied with a transfer voltage in a range from +1000 to +3000V, so that the toner image is transferred from the photosensitive drum 23 to the recording medium 100. The recording medium 100 (with the toner images of black, yellow, magenta and cyan) is conveyed to the fixing portion 40. The toner remaining on the surface of the photosensitive drum 23 is scraped off by the cleaning blade 29, and is collected for use in next toner image formation.

In the fixing portion 40, the recording medium 100 with toner images (of black, yellow, magenta and cyan) is nipped by the fixing roller 41 and the pressure roller 42 and is fed through a nip portion between the fixing roller 41 and the pressure roller 42. The toner is applied with heat and pressure by the fixing roller 41 and the pressure 42 and is molten, so that the toner image is fixed to the recording medium 100.

The recording medium 100 (to which the toner image is fixed) is further conveyed by the conveying rollers 47*a* and 47*b*, and is ejected outside the image forming apparatus 100 by the ejection rollers 48*a* and 48*b*. The ejected recording medium 100 is placed on the stacker portion 49.

Figure 10B:
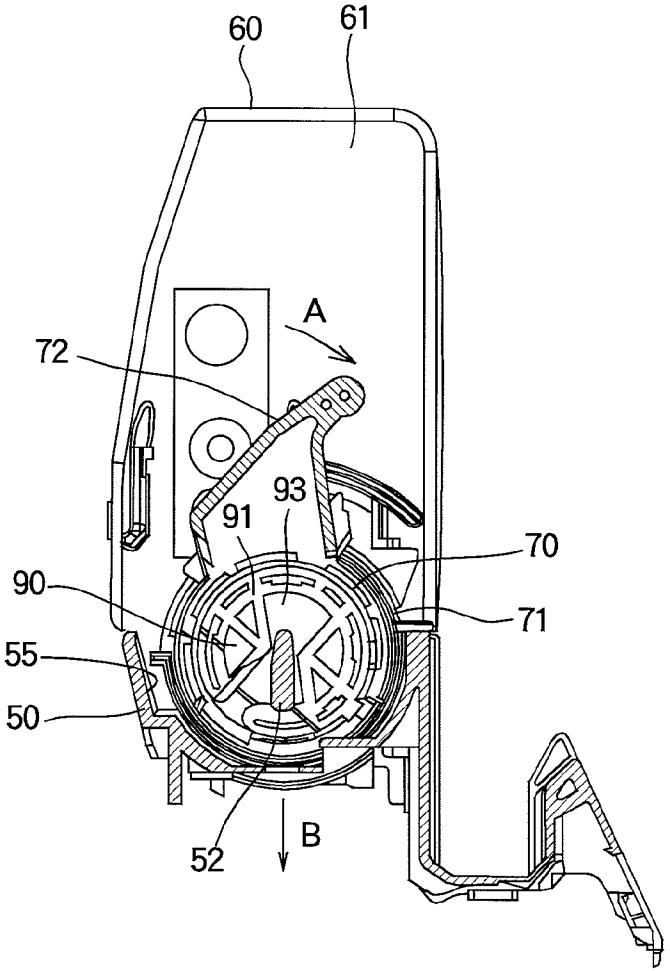
FIGS. 10A and 10B are schematic views for illustrating a mounting operation of the toner cartridge according to the first embodiment of the present invention.
Figure 10A:
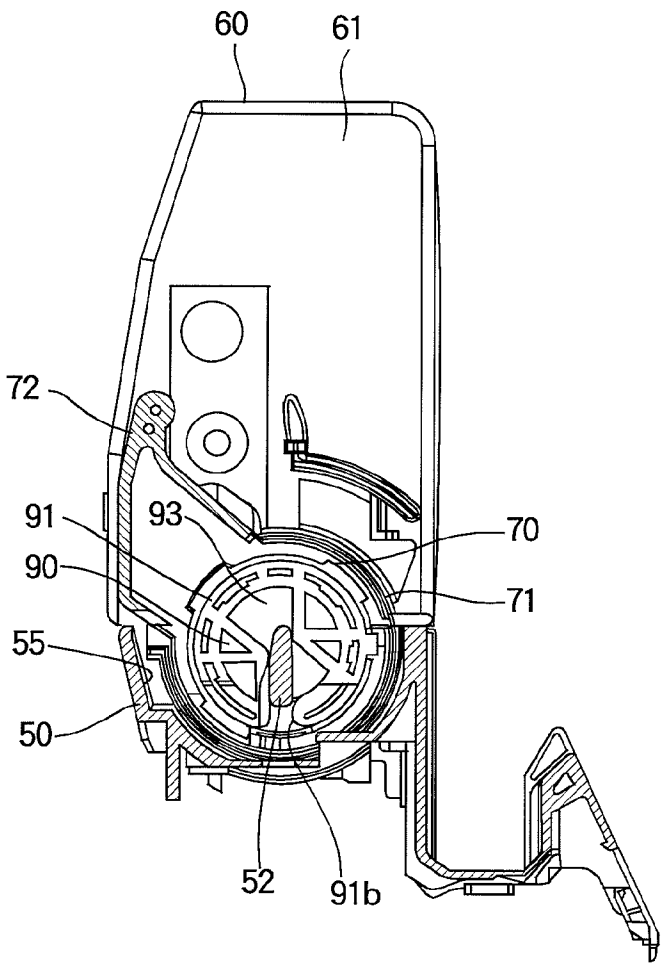

FIGS. 10A and 10B are schematic views showing a mounting operation of the toner cartridge 60 according to the first embodiment. To be more specific, both of FIGS. 10A and 10B show states where the toner cartridge 60 is mounted to the image forming unit main body 50. FIG. 10A shows a state where the toner is ejected from the toner cartridge 60, and FIG. 10B shows a state where the toner is not ejected from the toner cartridge 60.

In the state shown in FIG. 10A, the toner cartridge 60 is mounted to the upper part of the image forming unit main body 50, and the toner supply opening 65 (FIG. 6) is closed by the shutter 80. In this state, the opening 91*b* of the rib portion 91 is directed downward, and the protrusion 52 of the image forming apparatus main body 50 is inserted into the hollow portion 93 via the opening 91*b*. Since the opening 91*b* is directed downward, the toner cap 90 does not prevent the protrusion 52 from relatively moving downward. Therefore, the toner cartridge 60 can be lifted upward and detached from the image forming unit main body 50.

In the state shown in FIG. 10B, the operation lever 72 is rotated in the direction shown by the arrow A from the state shown in FIG. 10A. The shutter 80 (FIG. 6) rotates together with the rotation of the operation lever 72. The toner supply opening 65 is opened by the shutter 80, and the toner stored in the toner cartridge 60 is supplied through the toner supply opening 65 in a direction shown by an arrow B. The toner cap 90 (press-fitted into the shutter portion 70) rotates together with the rotation of the operation lever 72 due to engagement between the guide portion 95 (FIG. 6) and the guide groove 75 (FIG. 6) of the shutter portion 70. By the rotation of the toner cap 90, the rib portion 91 of the toner cap 90 engages the protrusion 52 of the image forming unit main body 50, and prevents the protrusion 52 from relatively moving downward. Therefore, the toner cartridge 60 is prevented (by the toner cap 90) from moving upward, and is fixed to the image forming unit main body 50.

That is, by rotating the shutter portion 70 (i.e., the shutter member) in a state where the protrusion 52 of the image forming unit main body 50 is inserted into the hollow portion 93 of the toner cap 90 (i.e., the cap portion), the rib portion 91 engages the protrusion 52, and the toner cartridge 60 is fixed to the image forming unit main body 50.

The toner cartridge 60 is fixed to the image forming unit main body 50 by the action of the toner cap 90, and therefore it is unnecessary to provide a fixing mechanism in addition to the toner cap 90.

The toner cartridge 60 of the first embodiment cannot be mounted to the image forming unit main body 50 in a state where the toner cap 90 is not mounted to the toner cartridge 60. Therefore, it is possible to prevent the toner cartridge 60 from being mistakenly mounted to the image forming unit main body 50 without having the toner cap 90.

The toner cartridge 60 of the first embodiment is fixed to the image forming unit main body 50 and becomes capable of supplying the toner through the toner supply opening 65, only by rotating the operation lever 72 in the direction shown by the arrow A.

Figure 11A:
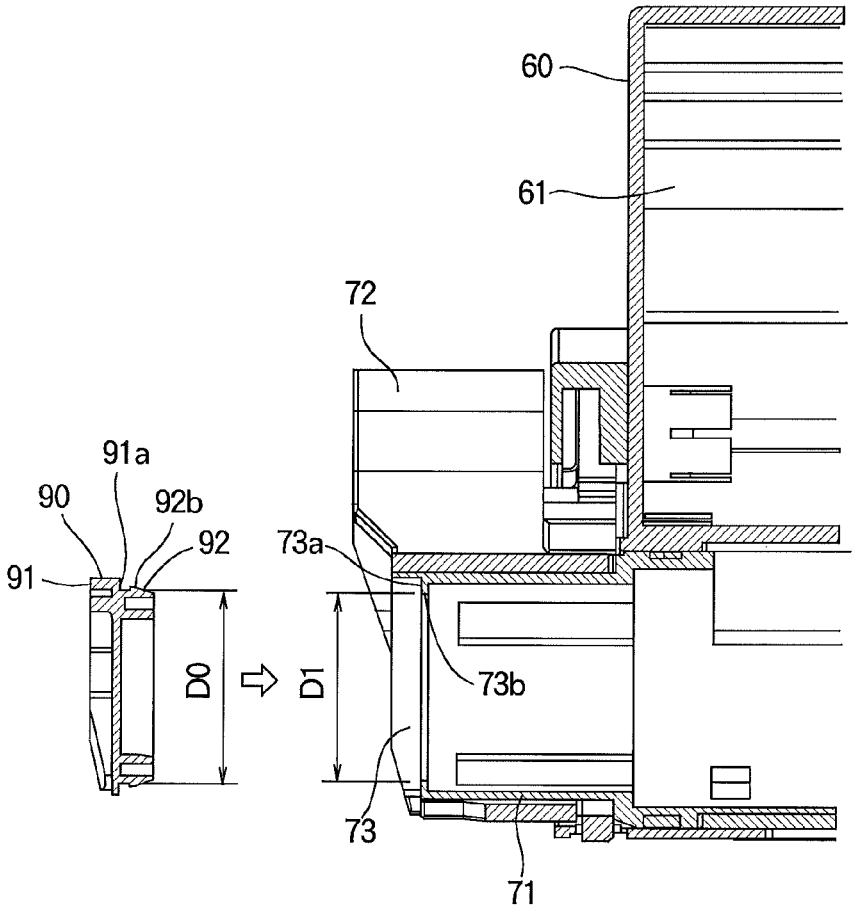
FIGS. 11A and 11B are sectional views showing a relationship between the toner cap and a shutter portion of the toner cartridge according to the first embodiment of the present invention.
Figure 11B:
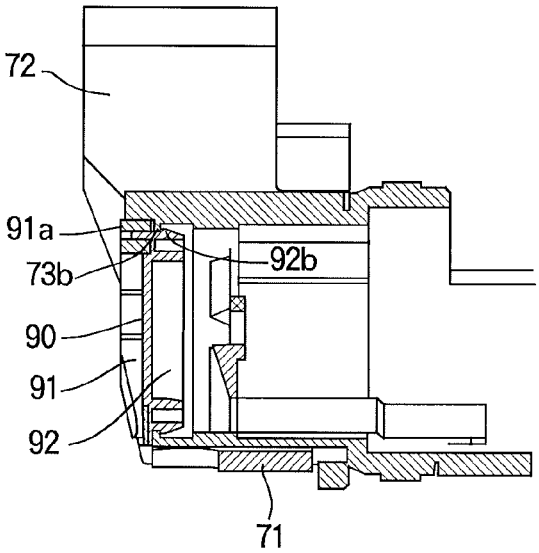

FIGS. 11A and 11B are sectional views showing a relationship between the toner cap 90 and the shutter portion 70 according to the first embodiment. FIG. 11A shows a state where the toner cap 90 is not yet mounted to the shutter portion 70. FIG. 11B shows a state where the toner cap 90 is mounted to the shutter portion 70. In FIG. 11A, the seal portion 92 of the toner cap 90 has an outer diameter D0, and the hole portion 73 has an inner diameter D1. In FIG. 11B, the toner cap 90 is press-fitted into the hole portion 73.

As shown in FIG. 11A, the outer diameter D0 of the seal portion 92 of the toner cap 90 is larger than the inner diameter D1 of the hole portion 73. Therefore, as shown in FIG. 11B, when the toner cap 90 is press-fitted into the hole portion 73, the seal portion 92 deforms (i.e., is compressed) so that the outer diameter of the seal portion 92 is reduced to D1. The compressed seal portion 92 tightly contacts the inner wall 73*b* of the hole portion 73, and effectively prevents the toner leakage from the toner cartridge 60.

<Advantages>

The toner cartridge 60, the image forming unit main body 50 and the image forming apparatus 10 according to the first embodiment provide the following advantages.

(A) The toner cap 90 of the first embodiment includes the rib portion 91 formed of the first material which is harder and has higher flexural modulus, and the seal portion 92 formed of the second material which is softer and has lower flexural modulus. Therefore, the seal portion 92 seals the hole portion 73 to prevent the leakage of the toner, and the rib portion 91 (which engages the protrusion 52 of the image forming unit main body 50) is prevented from being deformed by a force applied thereto.

(B) In the toner cap 90 of the first embodiment, the rib portion 91 (i.e., the harder portion) does not cover the entire surface of the seal portion 92, but is formed with a rib structure. The seal portion 92 (i.e., the softer portion) is exposed through the hollow portion 93. Therefore, when replenishing the toner to the toner cartridge 60, the toner cap 90 can be easily detached from the hole portion 73 by breaking through the exposed part of the seal portion 92 using a bar or the like. It is unnecessary to use a special tool.

(C) The toner cap 90 of the first embodiment is integrally formed of the rib portion 91 and the seal portion 92 having different hardness using double molding technique. That is, the toner cap 90 can be formed by a single process. Therefore, the toner cap 90 can be produced in a shorter time than when the rib portion 91 and the seal portion 92 are individually formed and are fixed using bonding, fitting and fastening.

(D) The toner cartridge 60 is fixed to the image forming unit main body 50 by the toner cap 90, and therefore it is unnecessary to provide a fixing mechanism (for fixing the toner cartridge 60 to the image forming unit main body 50) at a region other than a region where the toner cap 90 is provided. Therefore, the toner cartridge 60 can be compact in size.

(E) The toner cartridge 60 of the first embodiment cannot be fixed to the image forming unit main body 50 in a state where the toner cap 90 is not mounted to the toner cartridge 60. Therefore, it becomes possible to prevent the toner cartridge 60 from being mistakenly mounted to the image forming unit main body 50 without having the toner cap 90.

(F) The toner cartridge 60 of the first embodiment is fixed to the image forming unit main body 50 and becomes capable of supplying the toner through the toner supply opening 65, only by rotating the operation lever 72 in the direction shown by the arrow A.

Second Embodiment

<Configuration>

Figures 12A, 12B, 12C:
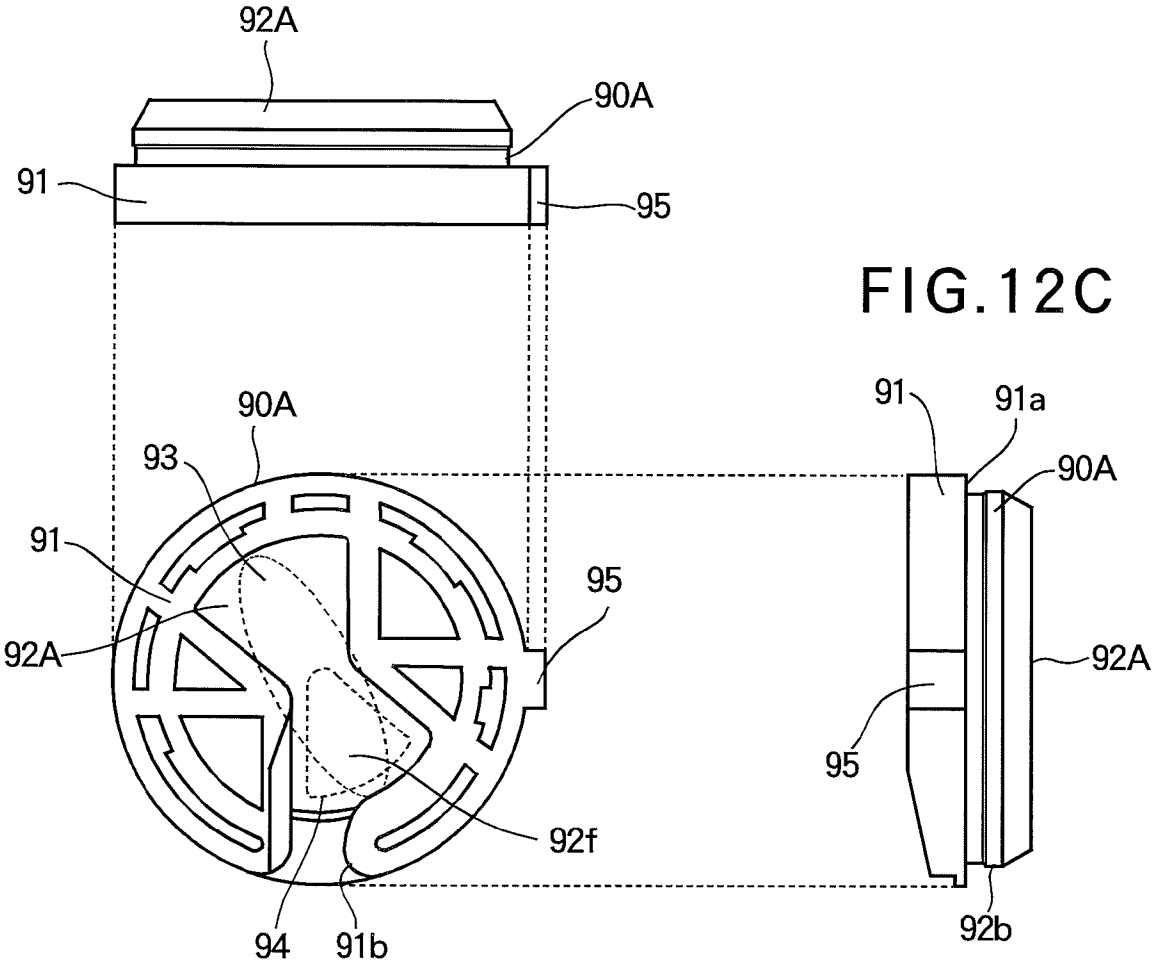
FIGS. 12A, 12B and 12C are front, bottom and side views showing a toner cap according to the second embodiment of the present invention.

FIGS. 12A, 12B and 12C are a front, bottom and side views showing the toner cap 90A according to the second embodiment of the present invention. In the second embodiment, elements identical with those of the first embodiment are assigned with the same reference numerals.

The toner cap 90A of the second embodiment has a seal portion 92A which is different from that of the first embodiment. The toner cap 90A of the second embodiment is the same as the toner cap 90 of the first embodiment in other respects.

The seal portion 92A of the toner cap 90A of the second embodiment has a groove portion 94 at a region corresponding to the hollow portion 93. The groove portion 94 has a cross section of a wedge shape (i.e., substantially V-shape) and extends so as to form a triangle. The groove portion 94 is surrounded by the rib portion 91 (i.e., the harder portion). That is, a part 92*f* of the seal portion 92A covering the hollow portion 93 is surrounded by the groove portion 94.

Figure 13A:
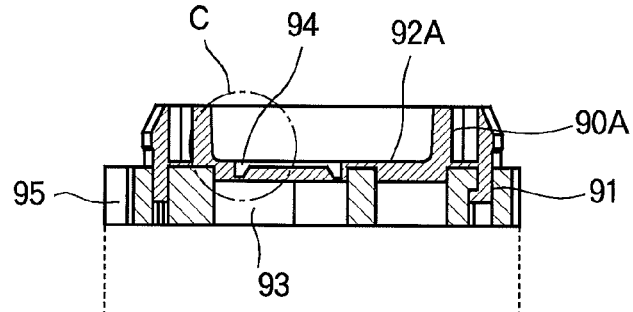
FIGS. 13A, 13B and 13C are a sectional view, a top view and an enlarged sectional view showing the toner cap according to the second embodiment of the present invention.
Figure 13B:
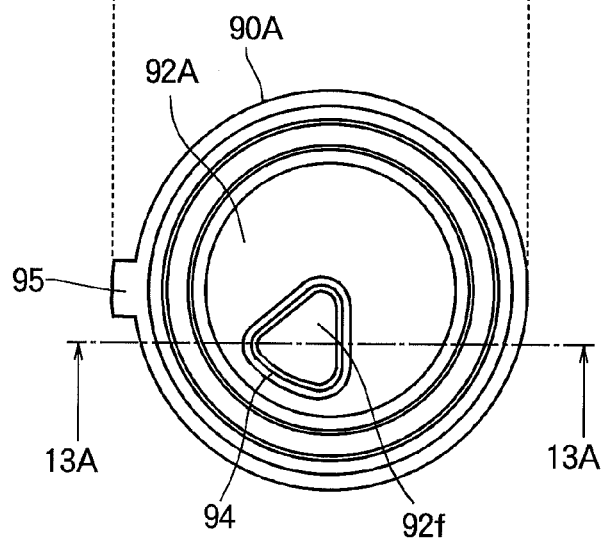
Figure 13C:
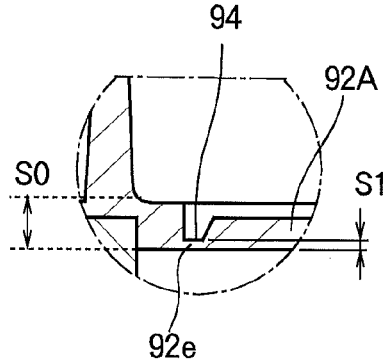

FIGS. 13A and 13B are a sectional view and a plan view showing the toner cap 90A according to the second embodiment. In this regard, FIG. 13A corresponding to a sectional view taken along line 13A-13A shown in FIG. 13B. FIG. 13B is a plan view of the toner cap 90A as seen from a fitting side (i.e., a side press-fitted into the hole portion 73). FIG. 13C is an enlarged view of a part indicated by a circle C in FIG. 13A.

In the second embodiment, the groove portion 94 having the wedge shape is formed on the fitting side (i.e., a side fitted into the hole portion 73) of the seal portion 92A. The groove portion 94 is located at a region corresponding to the hollow portion 93. The groove portion 94 has a width of 1 mm, and a depth of 1.2 mm. The seal portion 92A has a minimum thickness S1 of 0.3 mm at a part (i.e., a thinner part) 92*e* where the groove portion 94 is formed. The seal portion 92A (except the thinner part 92*e*) has a thickness S0 of 1.5 mm.

Figure 14:
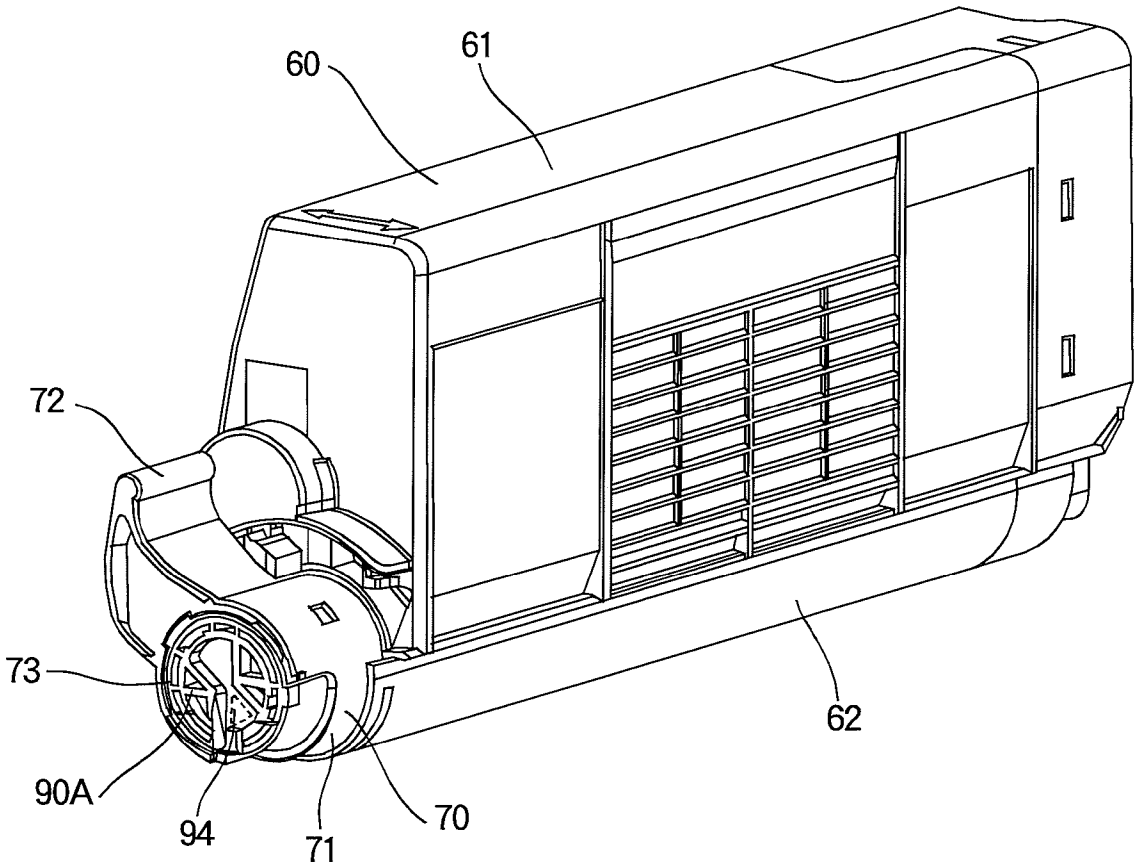
FIG. 14 is a perspective view showing a toner cartridge according to the second embodiment of the present invention.

FIG. 14 is a perspective showing a toner cartridge 60 of the second embodiment. Elements identical with those of the first embodiment are assigned with the same reference numerals.

The toner cartridge 60 of the second embodiment is the same as that of the first embodiment except the toner cap 90A.

<Operation>

A detaching operation of the toner cap 90A from the toner cartridge 60 according to the second embodiment will be described.

The seal portion 92A has the groove portion 94 that forms the thinner part 92*e*, and therefore, when replenishing the toner to the toner cartridge 60, the exposed part of the seal portion 92A can be easily broken at the groove portion 94. That is, the toner cap 90A can be easily detached from the hole portion 73 by breaking through the exposed part of the seal portion 92A using a bar, screwdriver or the like, and by forcing the toner cap 90A open using the bar or the like (penetrating the seal portion 92A) according to the principle of leverage. It is unnecessary to use a special tool. Thus, the toner cap 90A can be further easily detached from the hole portion 73 of the toner cartridge 60, as compared with the first embodiment.

More specifically, by applying a force to the seal portion 92A (at the hollow portion 93), the seal portion 92A can be easily broken at the groove portion 94. Further, since the groove portion 94 has the wedge shape, the seal portion 92A can be further easily broken at the groove portion 94, as compared with other shapes (for example, a U-shape, stepwise shape, or a single-step shape. Furthermore, since the groove portion 94 is surrounded by the rib portion 91 (i.e., the harder portion), a lowered strength of the seal portion 92A caused by the provision of the groove portion 94 does not affects the sealing performance of the toner cap 90A.

That is, the toner cap 90A of the second embodiment is can be easily detached from the toner cartridge 60 without using a special tool when replenishing the toner to the toner cartridge 60.

<Advantages>

The toner cartridge 60, the image forming unit main body 50 and the image forming apparatus 10 according to the second embodiment provide following advantages in addition to the advantages of the first embodiment.

(G) The seal portion 92A has the groove portion 94 that forms the thinner part 92*e* of the seal portion 92A. Therefore, when replenishing the toner to the toner cartridge 60, an exposed part of the seal portion 92A (i.e., the softer portion) can be further easily broken. That is, the toner cap 90A can be further easily detached from the toner cartridge 60 without using a special tool.

(H) The groove portion 94 is surrounded by the rib portion 91 (i.e., the harder portion). Therefore, a lowered strength of the seal portion 92A caused by the provision of the groove portion 94 does not affects the sealing performance of the toner cap 90A.

(I) The groove portion 94 has the wedge shape, and therefore the seal portion 92A can be further easily broken at the groove portion 94, as compared with other shapes (for example, a U-shape, stepwise shape, single-step shape).

Modifications.

The present invention is not limited to the above described embodiments. For example, the first and second embodiments may be modified as follows.

In the first and second embodiments, the tandem-type image printer has been described as an example of the image forming apparatus. However, the present invention is also applicable to, for example, a printer employing another printing method, a copier for copying a manuscript, a facsimile machine that transmits image information of manuscript via phone line and prints image information received via phone line, and a digital multifunction peripheral (MFP) having a copy, facsimile or printing function.

Figure 15A:
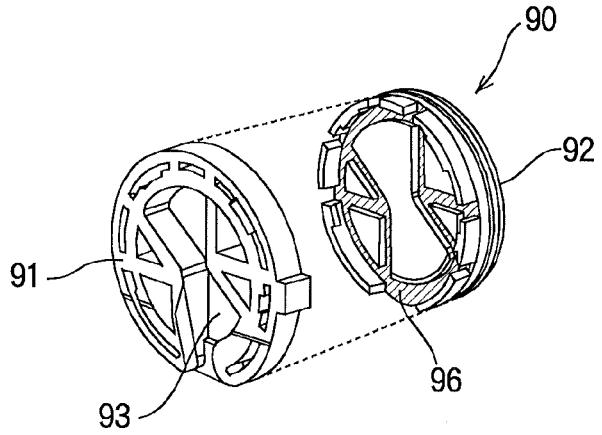
FIGS. 15A, 15B and 15C are perspective views showing toner caps according to modifications of the embodiments of the present invention.
Figure 15B:
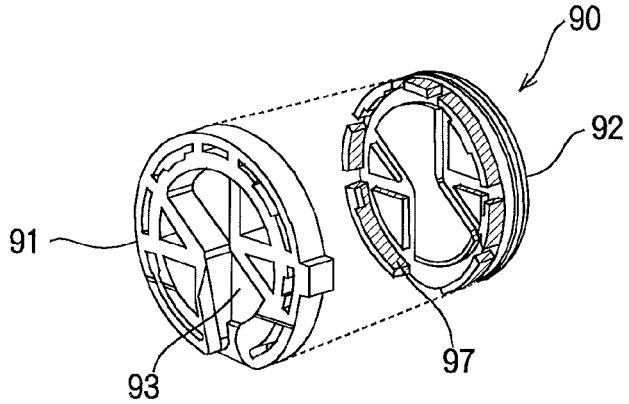
Figure 15C:
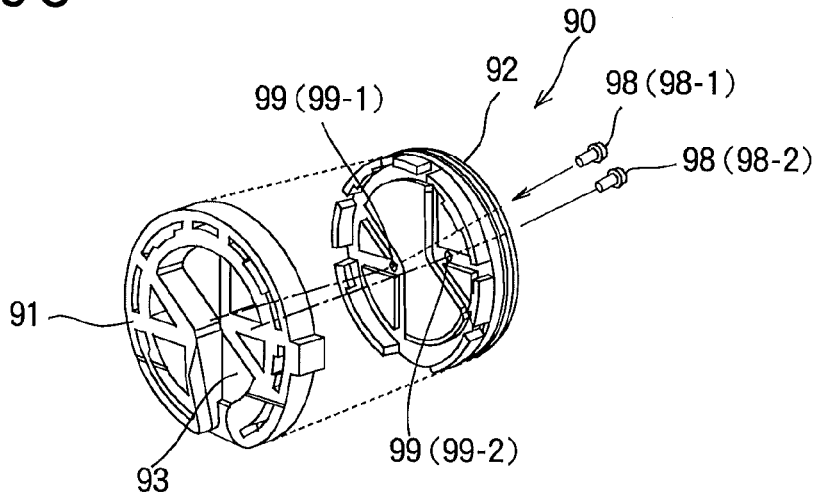

FIGS. 15A, 15B and 15C show structures of a toner cap according to the modification of the embodiments of the present invention.

In the above described first embodiment, the toner cap 90 is formed using the double molding technique. However, the present invention is not limited to the toner cap formed by double molding technique. For example, as shown in FIG. 15A, the toner cap 90 can be produced by forming the rib portion 91 and the seal portion 92 in separate processes, and fixing the rib portion 91 and the seal portion 92 to each other using bonding agent 96 applied to a bonding surface of the seal portion 92. Further, as shown in FIG. 15B, the rib portion 91 and the seal portion 92 can be fixed to each other by fitting the seal portion 92 into the rib portion 91 at a fitting surface 97. Furthermore, as shown in FIG. 15C, the rib portion 91 and the seal portion 92 can be fixed to each other by engaging two screws 98 (98-1 and 98-2) as fastening members into threaded holes formed on the rib portion 91 via holes 99 (99-1 and 99-2) formed on the seal portion 92. The same can be said for the toner cap 90A of the second embodiment.

In the first embodiment, the rib portion 91 is formed of polycarbonate as the first material and the seal portion 92 is formed of ethylene-vinyl acetate as the second material. However, the first material and the second material are not limited to these materials. It is only necessary that the second material is softer (i.e., has lower hardness) than the first material. For example, the second material can be formed of rubber. The same can be said for the toner cap 90A of the second embodiment.

In the second embodiment, the groove portion 94 has the wedge shape. However, the second embodiment is not limited to such a configuration. For example, it is also possible to reduce a thickness of an entire part of the seal member 92A corresponding to the hollow portion 93. Further, it is also possible that the groove portion 94 has a U-shape, stepwise shape, a single-step shape (i.e., rectangular shape) or the like.

In the second embodiment, the groove portion 94 is provided on the fitting side of the seal portion 92A. The groove portion 94 is located at the region corresponding to the hollow portion 93. However, the second embodiment is not limited to such a configuration. The groove portion 94 can also be formed at a side of the seal portion 92A opposite to the fitting side (and at the region corresponding to the hollow portion 93).

While the preferred embodiments of the present invention have been illustrated in detail, it should be apparent that modifications and improvements may be made to the invention without departing from the spirit and scope of the invention as described in the following claims.

What is claimed is:

1. A developer storage body comprising:

a housing in which a developer is stored;

a shutter portion mounted to said housing and having a hole portion through which said developer is replenished into said housing, said hole portion having a first direction-regulating portion; and a cap portion covering said hole portion, said cap portion having a second direction-regulating portion that engages said first direction-regulating portion, said second direction-regulating portion being an outer peripheral part of said cap portion, wherein said cap portion comprises:

a structural portion that constitutes an enclosure body enclosing a hollow portion, said structural portion being formed of a first material, and a seal portion that covers said structural portion to seal said hollow portion, said seal portion being formed of a second material having a lower flexural modulus than that of said first material.

2. The developer storage body according to claim 1, wherein said seal portion includes a first surface covering said structural portion and a second surface fitted into said hole portion.

3. The developer storage body according to claim 1, wherein said structural portion and said seal portion of said cap portion are bonded to each other using a bonding agent.

4. The developer storage body according to claim 1, wherein said structural portion and said seal portion of said cap portion are combined with each other by fitting said seal portion into said structural portion.

5. The developer storage body according to claim 1, wherein said structural portion and said seal portion are combined with each other using a fastening member.

6. The developer storage body according to claim 1, wherein the developer storage body includes a supply opening for supplying said developer to an image forming unit main body, wherein said shutter portion is configured to open and close said supply opening.

7. The developer storage body according to claim 6, wherein said supply opening is provided adjacent to said hole portion, and extends in a longitudinal direction of said developer storage body.

8. The developer storage body according to claim 1, wherein said shutter portion is rotatably provided in said housing, wherein said cap portion is mounted to an end portion of said shutter portion, the end portion protruding outside said housing.

9. The developer storage body according to claim 8, wherein said structural portion is disposed at an outer side of said seal portion with respect to said shutter portion.

10. The developer storage body according to claim 8, wherein the shutter portion includes an operating portion provided on said end portion of said shutter portion for rotating said shutter portion.

11. An image forming unit comprising:

said developer storage body according to claim 1; and an image forming unit main body to which said developer storage body is detachably mounted.

12. The image forming unit according to claim 11, wherein said image forming unit main body comprises:

a recess portion to which said developer storage body is mounted; and a protrusion provided in said recess portion, and wherein said developer storage body is mounted to said recess portion by fitting the cap portion into said hole portion, inserting said protrusion into said hollow portion of said cap portion, and rotating said cap portion to thereby cause said structural portion and said projection to engage each other.

13. An image forming apparatus comprising:

a medium storage portion;

a medium conveying portion;

said image forming unit according to claim 11; and a medium ejection portion.

14. The developer storage body according to claim 1, wherein said second direction-regulating portion is provided on said structural portion.

15. The developer storage body according to claim 1, wherein said second direction-regulating portion is a protrusion.

16. The developer storage body according to claim 15, wherein said second direction-regulating portion protrudes outward from said cap portion.

17. The developer storage body according to claim 1, wherein one of said first direction-regulating portion and said second direction-regulating portion is a protrusion, and the other of the said first direction-regulating portion and said second direction-regulating portion is a concave.

18. The developer storage body according to claim 1, wherein said first direction-regulating portion is a concave, and said second direction-regulating portion is a protrusion.

19. The developer storage body according to claim 1, said second direction-regulating portion is an outermost peripheral part of said cap portion in a radial direction of the cap portion.

20. A developer storage body comprising:

a housing in which a developer is stored;

a shutter portion mounted to said housing and having a hole portion through which said developer is replenished into said housing; and a cap portion covering said hole portion, wherein said cap portion comprises:

a structural portion that constitutes an enclosure body enclosing a hollow portion, said structural portion being formed of a first material, and a seal portion that covers said structural portion to seal said hollow portion, said seal portion being formed of a second material having a lower flexural modulus than that of said first material, wherein the flexural modulus of said first material is in a range from 1000 to 5000 MPa, and the flexural modulus of said second material is in a range from 50 to 200 MPa.

21. The developer storage body according to claim 20, wherein said hole portion has a first direction-regulating portion, and said cap portion has a second direction-regulating portion that engages said first direction-regulating portion.

22. A developer storage body comprising:

a housing in which a developer is stored;

a shutter portion mounted to said housing and having a hole portion through which said developer is replenished into said housing; and a cap portion covering said hole portion, wherein said cap portion comprises:

a structural portion that constitutes an enclosure body enclosing a hollow portion, said structural portion being formed of a first material, and a seal portion that covers said structural portion to seal said hollow portion, said seal portion being formed of a second material having a lower flexural modulus than that of said first material, wherein a predetermined portion of said seal portion that covers at least a part of said hollow portion is surrounded by a groove.

23. The developer storage body according to claim 22, wherein said groove has a cross section of a wedge shape, U-shape, stepwise shape or rectangular shape.

24. A developer storage body comprising:

a housing in which a developer is stored;

a shutter portion mounted to said housing and having a hole portion through which said developer is replenished into said housing; and a cap portion covering said hole portion, wherein said cap portion comprises:

a structural portion that constitutes an enclosure body enclosing a hollow portion, said structural portion being formed of a first material, and a seal portion that covers said structural portion to seal said hollow portion, said seal portion being formed of a second material having a lower flexural modulus than that of said first material, wherein said structural portion and said seal portion of said cap portion are formed by the same process.

* * * * *